United States Patent [19]

Every et al.

[11] 4,043,395

[45] Aug. 23, 1977

[54] METHOD FOR REMOVING METHANE FROM COAL

[75] Inventors: Richard L. Every, Warrington, Pa.; Luino Dell'Osso, Jr., Washington, D.C.

[73] Assignee: Continental Oil Company, Ponca City, Okla.

[21] Appl. No.: 693,561

[22] Filed: June 7, 1976

Related U.S. Application Data

[63] Continuation-in-part of Ser. No. 558,089, March 13, 1975, abandoned, which is a continuation-in-part of Ser. No. 252,072, May 10, 1972, abandoned.

[51] Int. Cl.[2] ..... E21B 43/00

[52] U.S. Cl. ..... 166/263; 166/268; 299/12; 48/DIG. 6

[58] Field of Search ..... 166/249, 263, 303, 305 R, 166/308, 245, 252, 268; 299/2, 5, 12, 16, 3, 4; 48/210, DIG. 6

[56] References Cited

U.S. PATENT DOCUMENTS

| | | | |
|---|---|---|---|
| 1,152,392 | 9/1915 | Brietung et al. | 166/303 |
| 1,992,323 | 2/1935 | Ranney | 299/2 |
| 3,384,416 | 5/1968 | Ruehl | 299/16 |
| 3,493,049 | 2/1970 | Matthews et al. | 166/263 |
| 3,506,309 | 4/1970 | Hippel | 299/2 |
| 3,915,234 | 10/1975 | Pelofsky | 299/5 X |

FOREIGN PATENT DOCUMENTS

| | | | |
|---|---|---|---|
| 1,081,846 | 4/1957 | Germany | 299/12 |
| 1,080,853 | 8/1967 | United Kingdom | 299/12 |

*Primary Examiner*—S. Leon Bashore
*Assistant Examiner*—Peter F. Kratz
*Attorney, Agent, or Firm*—Richard W. Collins

[57] ABSTRACT

A process for removing methane from a subterranean coal deposit. A carbon dioxide-containing fluid is introduced into the coal deposit through an injection well and held therein for a period sufficient to enable a substantial amount of methane to be desorbed from the surfaces of the coal deposit. Following the hold period, the injected carbon dioxide-containing fluid and desorbed methane are recovered through a recovery well or wells spaced from the injection well. The process is repeated until sufficient methane has been removed to enable safe mining of the coal deposit.

5 Claims, No Drawings

METHOD FOR REMOVING METHANE FROM COAL

REFERENCE TO RELATED APPLICATIONS

This application is a continuation-in-part application of Ser. No. 558,089, filed Mar. 13, 1975 and now abandoned, which in turn is a continuation-in-part application of Ser. No. 252,072, filed May 10, 1972 and now abandoned.

BACKGROUND OF THE INVENTION

1. Field of the Invention

The present invention relates to an improved method of removing methane from subterranean coal deposits.

The inclusion of methane in coal beds has long been a safety problem in many areas of the world. The methane is tightly absorbed in the coal micropores and on the coal surfaces, and is released during mining, creating a safety hazard.

2. Brief Description of the Prior Art

There have been many attempts to overcome the problem of methane in coal deposits in the past. Early attempts to overcome the problem involved drilling a series of vent holes in the coal deposit in the hope that the methane would flow from the coal deposit out the vent holes. Later attempts included such things as applying vacuum to the coal deposit to accelerate methane removal, and additionally attempts have been made to displace the methane by passing a displacing fluid such as gas or water through the deposit. All of these attempts have been successful in some degree, but they have not been completely satisfactory due to the inadequate removal of methane obtained by these processes and also due to the excessive time required to carry out these processes. The rate of advance in working up coal seams has been greatly increased with the advent of mechanization of underground coal mining. With the more rapidly advancing working face, the release of methane gas from the coal and the surrounding rock occurs constantly due to release of rock pressure and crack formations connected therewith. For this reason, in order to maintain adequate safety standards, operation of mechanized coal mines must be interrupted from time to time while steps are taken to maintain the concentration of methane gas below the permissible maximum. The interruption of the mining operation is undesirable for both technical and economic reasons.

U.S. Pat. No. 3,384,416 issued to Ruehl describes a method for fracturing and degassing of coal seams, utilizing a volatile low-boiling liquid for injection into the coal seam to form a gaseous mixture of volatilized liquid and mine gas and thereafterward withdrawing the thus formed gaseous mixture through the injection well from the thus fractured zone to relieve the latter of mine gas. Ruehl teaches carbon dioxide as being a suitable volatile low-boiling liquid for use in his method. However, the method taught by Ruehl suffers in that long periods of time are required to remove significant amounts of methane gas from the coal, and the area affected by the treatment is limited to the immediate vicinity of the injection well. There has been a continuing need for a faster and more efficient method of removing methane from coal deposits.

SUMMARY OF THE INVENTION

According to the present invention, methane is removed from a subterranean coal deposit by a process including pressurizing the coal deposit by injection of a carbon dioxide-containing fluid through an injection well extending into the coal deposit, shutting in the deposit for a time sufficient to enable a substantial amount of absorbed methane to be desorbed into the injected fluid, and then producing the injected fluid with adsorbed and displaced methane through a separate recovery well or wells spaced from the injection well. The aforementioned steps are repeated until the methane level in the coal deposit is reduced to a safe level. It has been found that the process of this invention increases the recovery of methane compared to the recovery obtained by continuous injection and recovery of a carbon dioxide-containing fluid through a coal deposit.

It is accordingly an object of the present invention to provide an improved method for removing methane from a subterranean coal deposit.

A further object of the invention is to provide an effective, simple, and economic method, whereby a large amount of methane gas can be removed from a coal deposit in a short period of time.

DESCRIPTION OF THE PREFERRED EMBODIMENTS

In carrying out the process of the present invention, the carbon dioxide-containing fluid may be employed either in a liquid or gaseous form and may be introduced into the coal deposit by any of the conventional techniques now practiced by those skilled in the art. For example, it could be introduced by pressure into injection wells from the surface.

In the practice of the invention, the carbon dioxide-containing fluid must be introduced into the coal-containing formation under sufficient pressure to overcome the formation pressure. Once the desired amount of carbon dioxide-containing fluid has been injected into the formation, injection is ceased and the formation is shut in so that the carbon dioxide-containing fluid remains in contact with the coal for a period of time. During this shut-in period, methane is desorbed from the surfaces of the coal into the injected fluid. Following the shut-in period, the injected fluid, including desorbed and displaced methane, is removed from the recovery well. The total methane removed includes an amount which is simply physically displaced or swept out by the injected fluid, and a larger amount which is desorbed from the coal surfaces during the shut-in period. An important feature of the invention is the discovery that the amount of methane desorbed is greater when the process of the invention is carried out than when the fluid is continuously injected through the formation. The procedure is repeated a sufficient number of times to remove sufficient methane to enable safe access to coal-bearing formation.

As previously stated, the carbon dioxide-containing fluid is injected into the coal-bearing formation at sufficient pressure to overcome the formation pressure present in the subterranean formation. While the injection pressure employed can vary widely, one must insure that the pressure does not exceed the cracking pressure of the rock in the formation. The temperature at which the carbon dioxide-containing fluid is injected into the formation can vary widely also. It is important that the temperature of the injected fluid not exceed the autoignition point of the coal. Especially desirable results are obtained when the carbon dioxide-containing fluid is injected into the formation at a temperature in the range of from ambient temperature to about 300° F.

Another important facet of the invention is the rate at which the carbon dioxide-containing fluid is injected into the formation. This depends on the physical properties of the coal deposit, the well spacing and pattern, and economic considerations. It will be apparent that the injection rates, shut-in periods, and injection periods will vary according to the type of equipment used in order to economically and efficiently utilize same.

In a full scale operation on an actual subterranean coal deposit, the spacing and geometry of the injection and recovery well patterns would be in part dictated by the extent of the deposit, plans for developing the deposit in a particular direction, the area under consideration, depth of the deposit, etc. Such factors are understood by those skilled in the art. Ideally, the recovery well or wells are several hundred feet from an injection well. Several recovery wells may be used for each injection well. After injection of the carbon dioxide-containing fluid, such as at a pressure and for a time to provide a pressure of several hundred psi above the normal pressure in the affected area of the deposit, injection is ceased, and the deposit is maintained for a period of time such as several hours to allow adsorbed methane to be desorbed from the coal surfaces into the injected fluid. At this point, the recovery wells are opened and the pressure bled off by recovering injected fluid along with desorbed and displaced methane. After this, the recovery wells are preferably closed, the injection wells again utilized to inject further carbon dioxide-containing fluid, and the entire operation is repeated until the methane content in the deposit is at a safe level.

A typical operation will now be described. A coal deposit is penetrated by a centrally positioned injection well and four recovery wells spaced therefrom to provide a "five spot" well pattern. The recovery wells are each spaced about 300 feet from the injection well and from a square with the injection well at the center. With the recovery wells closed, flue gas containing about 20 volume percent carbon dioxide is injected through the injection well in an amount, considering the area, thickness and porosity of the affected zone, to provide a pressure in the affected zone, defined by the recovery wells, of about 200 psi. It will be appreciated that there will be a pressure gradient outwardly from the injection well, and that the injected fluid may not be uniformly distributed through the portion of the deposit being treated. However, the distribution will be much more uniform than for a conventional displacement operation. After injection of the desired amount of fluid, the injection well is closed in for about 4 hours. During the closed-in period, methane is desorbed into the quiescent injected fluid. At the end of the shut-in period, the recovery wells are opened and injected gas along with desorbed and displaced methane is recovered. The procedure is then repeated until the methane level in the coal deposit is at a safe level. Most coal deposits are characterized by a high surface area per unit of weight and also include a high porosity due to a large number of micropores. The deposits also generally include fractures of layers of relatively high permeability such that if a displacement fluid is continuously injected, it will tend to follow the fractures and will not contact the main portion of the coal deposit. Since much of the contained methane is adsorbed on the surfaces of the micropores, a simple displacement is relatively ineffective. However, the process of this invention, including substantial shut-in periods at elevated pressure, enables the injected fluid to diffuse into the micropores to desorb methane from the surfaces thereof. Subsequent pressure drawdown and production from the recovery wells enables the desorbed methane to be recovered.

The term carbon dioxide-containing fluid as used in this application is understood to include carbon dioxide and carbon dioxide-containing gases, such as flue gases, off gases from limestone kilns, off gases from cement kilns, and the like. Such off gases are known to contain about 20 percent by weight carbon dioxide.

The following examples illustrate the effective operation of the improved method described herein. The examples shown illustrate the comparative displacement results between continuous pumping of carbon dioxide, extended shut-in periods, and the pulsating introduction of carbon dioxide at defined intervals.

Laboratory test samples were made by crushing blocks of coal and sieving the crushed product to obtain a 10 × 18 mesh sample. After sieving, the coal was packed into a ⅜-inch diameter stainless steel column 20 feet long. The packed density of the coal was nominally 0.8 grams of coal per cc of column volume. The column void volume, based on the coal particle density (1.327 g/cc, helium density), was nominally 139 cc (40 percent of column volume).

After packing, the column was inserted into a displacement apparatus. The flow rate of the gas to be injected into the column was established through the column bypass by dropping the run pressure to 40 psig through Victor pressure regulator and setting the flow controller at the reduced pressure. The actual rate through the flow controller was measured with a soap bubble meter. Once the flow controller was set, the column was pressured to the run pressure and the system downstream of the Victor pressure regulator evacuated. Flow was then diverted through the column as the appropriate gas collection vessel was opened.

The time of gas flow in each part of a given run varied from 30 minutes to 18 hours. During each part of the test, all of the gas exiting from the packed volume was collected in a single vessel. The volume of the collected vessels was determined by filling them with water. The volume of the tubing and gauges associated with the collection vessels was calculated by expanding a gas from a known volume into the tubing and gauges and recording the pressure and temperature.

Chemically pure carbon dioxide at 99.8 mole percent was used in the displacement runs. The analyses of the gases collected in the runs shown in the tables were made with a conventional F & M 700 analytical gas chromatograph.

In the tables, one void volume equaled the empty column volume minus (coal weight/coal helium density.

In each table, an explanation of the terms is believed desirable. The following will serve as such.

EXPLANATION OF REMARKS

The term "shut-in" is to be understood to mean that the sample of coal, previously discussed, was charged with $CO_2$ until the desired pressure was obtained. The test apparatus was then closed off for the period of time indicated. The term "run" is to be understood that after the sample had been shut in for the desired period of time, the displaced methane was withdrawn and the sample flushed with a $CO_2$ sweep.

The term "continuous" is to be understood to mean that $CO_2$ is injected during the prescribed period of time while withdrawing displaced methane. The flow rates of the injection of $CO_2$ and removal of methane are regulated so as to maintain the desired pressure on the system.

TABLE I

DISPLACEMENT OF METHANE FROM 10 × 18 MESH COAL WITH CARBON DIOXIDE

| | |
|---|---|
| Weight of Coal | 271.0 g |
| Column Pressure | 216.2 psia |
| Run Temperature | 74° F |
| Gas Collection System Volume | 10029 cc |

(Column at atmospheric pressure prior to start of run)

| Collection System P (mm Hg Abs) | $CO_2$ Injection Rate (V.V./hr) * | Methane Displaced Mol. Fr. | mg | mg/g coal | Remarks |
|---|---|---|---|---|---|
| 167.4 | 1.2 | 0.0304 | 44.3 | 0.160 | Shut-in approx 1 hr; 1 hr run |
| 194.3 | 1.2 | 0.0169 | 28.6 | 0.100 | Shut-in approx 15 min; 1 hr run |
| 184.1 | 1.2 | 0.0092 | 14.8 | 0.055 | Shut-in approx 15 min; 1 hr run |
| 189.1 | 1.2 | 0.0559 | 74.0 | 0.270 | Shut-in 15 hrs; pressure fell 22 psi; repressured to 203 psig; 1 hr run |
| 177.0 | 1.2 | 0.0119 | 18.3 | 0.067 | Shut-in 2 hrs 40 min; 1 hr run |
| 200.6 | 2.4 | 0.0092 | 16.1 | 0.059 | Shut-in 2 hrs 40 min; ½ hr run |
| 180.4 | 2.4 | 0.0654 | 102.8 | 0.380 | Shut-in 66 hrs; pressure fell 68 psi; repressured to 203 psig; ½ hr run |
| 189.4 | 2.4 | 0.0093 | 15.4 | 0.057 | Shut-in 4 hrs; pressure fell 20 psi; repressured to 203 psig; ½ hour run |
| 583.9 | 2.4 | 0.0016 | 8.1 | 0.030 | Shut-in 1 hr; 1½ hr run |
| 191.5 | 2.4 | 0.0160 | 26.7 | 0.099 | Shut-in 16 hrs; pressure fell 32 psi; repressured to 202 psig; ½ hr run |
| 193.5 | 2.4 | 0.0029 | 4.9 | 0.018 | Shut-in 1.5 hrs; ½ hr run |
| 292 | — | 0.0012 | 3.1 | 0.011 | Column pressure expanded into gas collection system |
| | | TOTALS | 357.1 | 1.320 | |

* V.V./hr - void volumes/hour

The above data are cumulative and illustrate the intermittent injection of $CO_2$ into the coal sample.

TABLE II

DISPLACEMENT OF METHANE FROM 10 × 18 MESH COAL WITH CARBON DIOXIDE

| | |
|---|---|
| Weight of Coal | 278.6 g |
| $CO_2$ Injection Rate | 1.35 void volumes/hour |
| Column Pressure | 214.4 psia |
| Run Temperature | 74° F |

(Column at atmospheric pressure prior to start of run)

| Collection System P (psia) | Vol. (cc) | $CO_2$ Injected (V.V.) | Methane Displaced Mol. Fr. | mg | mg/g coal | Time from Start of Test (hrs) |
|---|---|---|---|---|---|---|
| 32.7 | 1079 | 1.35 | 0.0114 | 18.1 | 0.065 | 0 to 1 |
| 32.8 | 1063 | 1.35 | 0.0113 | 17.7 | 0.063 | 1 to 2 |
| 33.9 | 1065 | 1.35 | 0.0240 | 38.9 | 0.140 | 5 to 6 |
| 52.3 | 10165 | 23.6 | 0.0049 | 116.7 | 0.420 | 6 to 23.5 |
| 34.2 | 1063 | 1.35 | 0.0032 | 5.2 | 0.019 | 23.5 to 24.5 |
| 33.9 | 1065 | 1.35 | 0.0370 | 60.0 | 0.220 | 48 to 49 |
| | | | TOTALS | 256.6 | 0.927 | |

TABLE III

DISPLACEMENT OF METHANE FROM 10 × 18 MESH COAL With WITH DIOXIDE

| | |
|---|---|
| Weight of Coal | 270.5 g |
| $CO_2$ Injection Rate | 1.2 void volumes/hour |
| Column Pressure | 864 psia |
| Run Temperature | 76° F |

(Column evacuated to 10 mm Hg Abs prior to start of run)

| Collection System P (psia) | Volume (cc) | $CO_2$ Injected (V.V.) | Methane Displaced Mol. Fr. | Mg | Mg/g coal | Remarks (Elapsed Time, Hrs) |
|---|---|---|---|---|---|---|
| 224.6 | 1090 | 1.2 | 0.0012 | 13.5 | 0.050 | One hour run (0 to 1) |
| 223.1 | 1088 | 1.1 | 0.0010 | 11.1 | 0.041 | Total 2 hrs continuous (1 to 2) |
| 212.6 | 1090 | 1.2 | 0.0013 | 13.8 | 0.051 | Total 3 hrs continuous (2 to 3) |
| 329.0 | 10293 | 20.4 | 0.0007 | 110.2 | 0.410 | Shut-in 2 hrs. then 17 hr run (3 to 22) |
| 210.5 | 1090 | 1.2 | 0.0035 | 36.9 | 0.140 | Total 18 hrs continuous (22 to 23) |
| 221.8 | 1090 | 1.2 | 0.0086 | 95.6 | 0.350 | Shut-in 72 hrs, Col. P fell 62 psi; repressured to 850 psig; 1 hr run (23 to 96) |
| 212.0 | 1088 | 1.2 | 0.0003 | 3.2 | 0.012 | Total 2 hrs continuous (96 to 97) |
| 23.5 | 10293 | 1.2 | 0.0002 | 2.1 | 0.008 | Total 3 hrs continuous (97 to 98) |
| | | | TOTALS | 286.4 | 1.062 | |

TABLE IV

DISPLACEMENT OF METHANE FROM 10 × 18 MESH COAL WITH CARBON DIOXIDE

| | |
|---|---|
| Weight of Coal | 274.0 g |
| $CO_2$ Injection Rate | 1.2 void volumes/hours |
| Column Pressure | 214.3 psia |
| Run Temperature | 77° F |

(Column evacuated to 10 mm Hg Abs prior to start of run)

| Collection System | | $CO_2$ | Methane Displaced | | | Displaced | |
|---|---|---|---|---|---|---|---|
| P (psia) | Vol (cc) | Injected (V.V.) | Mol. Fr. | mg. | mg/g coal | $O_2/N_2$ | Remarks (Elapsed Time, Hrs) |
| 20.3 | 1090 | 1.2 | 0.0184 | 18.1 | 0.066 | 0.28 | One hour run (0 to 1) |
| 20.3 | 1088 | 1.2 | 0.0255 | 25.1 | 0.092 | 0.27 | Total 2 hours continuous (1 to 2) |
| 21.3 | 1090 | 1.2 | 0.0182 | 18.8 | 0.069 | 0.29 | Total 3 hours continuous (2 to 3) |
| 27.0 | 10293 | 21 | 0.0090 | 111.6 | 0.410 | 0.28 | Total 20.5 hrs continuous (3 to 20.5) |
| 20.5 | 1090 | 1.2 | 0.0052 | 5.2 | 0.019 | 0.29 | Total 21.5 hrs continuous (20.5 to 21.5) |
| 29.5 | 1090 | 1.2 | 0.0901 | 129.2 | 0.470 | 0.23 | Shut-in 74 hrs, then 1 hour run (21.5 to 96.5) |
| 26.3 | 1088 | 1.2 | 0.0175 | 22.3 | 0.081 | 0.31 | Total 2 hours continuous (96.5 to 97.5) |
| 29.5 | 1088 | 1.2 | 0.0281 | 40.2 | 0.150 | 0.24 | Shut-in 47.5 hours, then 1 hour run (97.5 to 146) |
| | | | TOTALS | 370.6 | 1.350 | | |

From the foregoing tables, it is shown that doubling injection rate has very little effect on methane removal and increasing the injection pressure has little effect on the total amount of methane displaced. Also, it should be noted that for a like operating period, much more methane will be displaced utilizing the present invention than either continuous pumping or extended shut-in periods. Extended shut-in periods do not yield the amount of methane that is displaced by the method of the present invention for the same period of time.

Having thus described the invention, we claim:

1. A process for removing methane from a subterranean coal deposit comprising:

a. providing at least one injection well and at least one recovery well spaced therefrom, said wells extending from the surface to said coal deposit;

b. pressurizing said coal deposit by injecting a gaseous fluid containing at least about 20 percent by weight carbon dioxide through said injection well at a pressure not exceeding the cracking pressure of said deposit into said coal deposit while maintaining said recovery well closed;

c. stopping said injection and maintaining said deposit in a pressurized condition for a period of time sufficient to enable a substantial amount of methane which is adsorbed on said coal deposit to be desorbed therefrom;

d. opening said recovery well after step (c) to recover injected fluid and desorbed methane from said coal deposit;

e. closing said recovery well after step (d); and f. repeating steps (b) through (e) until enough methane has been removed from said coal deposit to enable the deposit to be worked safely.

2. The method of claim 1 wherein said carbon dioxide-containing fluid is a gaseous compound selected from the group consisting of carbon dioxide, flue gas, off-gas from a limestone kiln and off-gas from a cement kiln.

3. The method of claim 1 wherein said fluid is carbon dioxide.

4. The method of claim 1 wherein a plurality of recovery wells spaced about said injection well are provided.

5. The method of claim 1 wherein sufficient carbon dioxide is injected to provide a pressure of about 200 psi throughout the zone defined by said recovery wells.

* * * * *